US006523288B1

(12) United States Patent
Sackett

(10) Patent No.: US 6,523,288 B1
(45) Date of Patent: Feb. 25, 2003

(54) FOLDABLE DISPLAY PANEL

(75) Inventor: Gayle A. Sackett, 1412 E. Reno St., Broken Arrow, OK (US) 74012

(73) Assignee: Gayle A. Sackett, Broken Arrow, OK (US)

( * ) Notice: Subject to any disclaimer, the term of this patent is extended or adjusted under 35 U.S.C. 154(b) by 24 days.

(21) Appl. No.: 09/666,354

(22) Filed: Sep. 20, 2000

(51) Int. Cl.[7] ..... G09F 1/08

(52) U.S. Cl. ..... 40/539; 40/538; 40/605; 40/610; 40/124.09; 446/27; 160/35

(58) Field of Search ..... 40/538, 539, 605, 40/610, 124.09; 428/9, 12; 160/35; 446/100, 321, 337, 26, 27, 28; 472/133; 396/1

(56) References Cited

U.S. PATENT DOCUMENTS 149,724 A * 4/1874 Coolidge ..... 396/3
377,556 A * 2/1888 Gomber ..... 396/1
389,414 A 9/1888 Sherwood
929,980 A * 8/1909 Popper ..... 40/538
1,520,420 A 12/1924 Kideney et al.
2,111,520 A * 3/1938 White ..... 40/124.09
2,489,240 A * 11/1949 Meyer ..... 446/147
D159,019 S 6/1950 Valentine ..... D34/15
3,018,100 A * 1/1962 Joseph ..... 472/133
3,156,758 A 11/1964 Tregubenko ..... 88/75
3,247,628 A 4/1966 Miller ..... 52/6
3,599,240 A * 8/1971 Shapur ..... 446/26
4,022,461 A 5/1977 Harris
4,275,520 A * 6/1981 Appleton et al. ..... 40/605
4,751,115 A * 6/1988 Smith et al. ..... 428/12
4,794,712 A * 1/1989 Wood ..... 40/605
4,877,074 A * 10/1989 Castellano ..... 160/84.1
4,919,982 A 4/1990 Hayes
D311,225 S 10/1990 Kroll ..... D21/114
5,046,543 A * 9/1991 Levy ..... 160/84.1
5,421,112 A 6/1995 Knorr
5,445,380 A * 8/1995 Polsky ..... 446/487
5,470,301 A * 11/1995 Brunt, II ..... 493/323
5,515,900 A * 5/1996 West et al. ..... 160/135
5,560,413 A * 10/1996 Brown ..... 160/135
5,570,735 A * 11/1996 Chu ..... 160/135
5,778,578 A * 7/1998 Drapcho et al. ..... 40/491
5,941,570 A * 8/1999 Cole et al. ..... 281/38
5,960,848 A 10/1999 Schirer
6,036,249 A * 3/2000 Kuntz ..... 160/135
6,163,991 A * 12/2000 Drapcho et al. ..... 40/124.09
6,305,455 B1 * 10/2001 Wendel ..... 160/135

* cited by examiner

*Primary Examiner*—Lynne H. Browne
*Assistant Examiner*—James M. Hewitt
(74) *Attorney, Agent, or Firm*—Fellers, Snider, Blankenship, Bailey & Tippens, P.C.

(57) ABSTRACT

A foldable display panel wherein a plurality of individual panels, each panel being small enough to be easily transportable and storable, are hingably connected in such a manner that in a folded state, the individual panels will fold into a single stack wherein the frontal surface area will be that of an individual panel and, in an unfolded state, the individual panels will unfold into a large flat panel wherein the frontal surface area will be substantially equal to the sum of the frontal surface areas of the individual panels. In the unfolded state, binders temporarily join the individual panels into a single, rigid panel.

6 Claims, 5 Drawing Sheets

*Fig. 6*
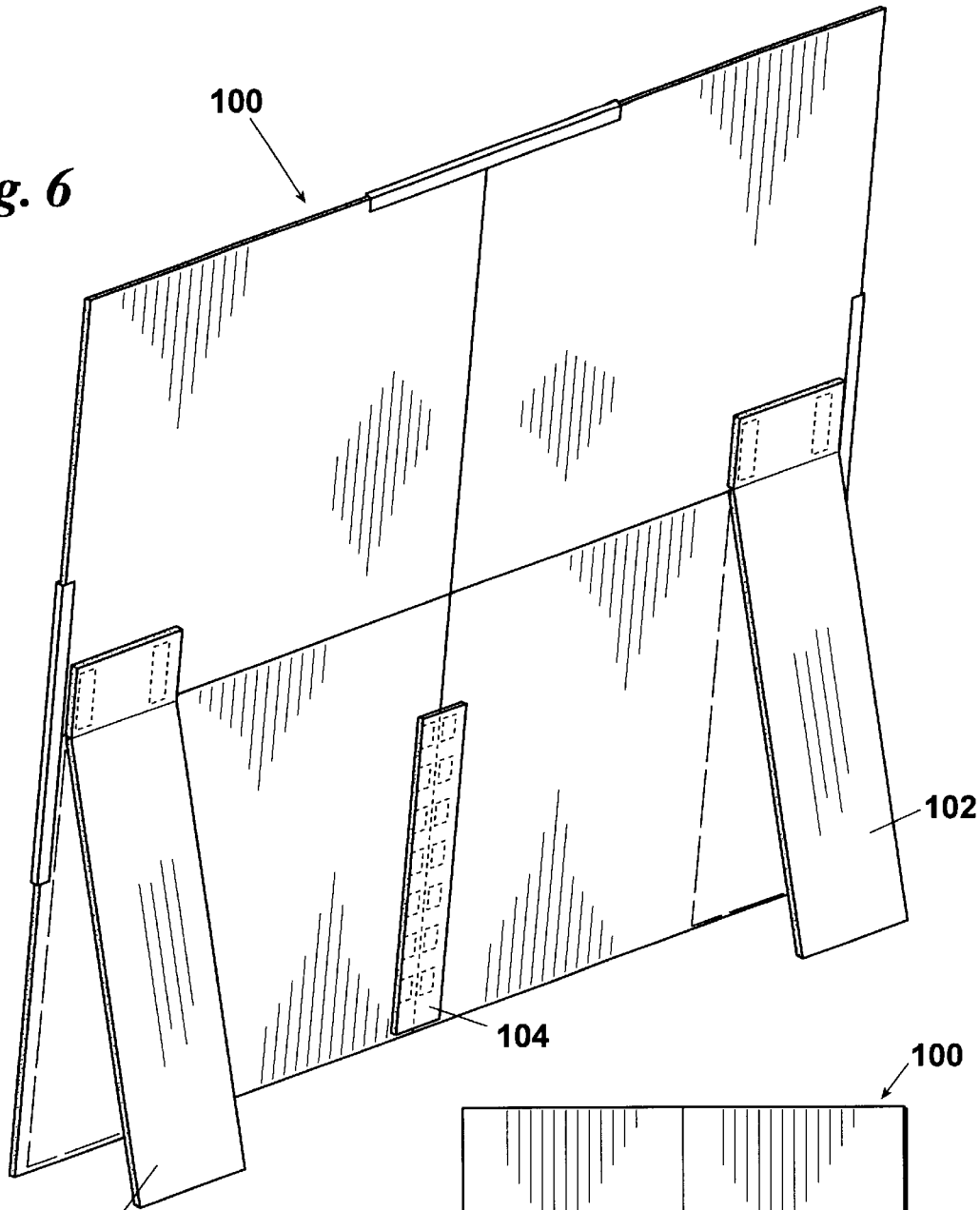
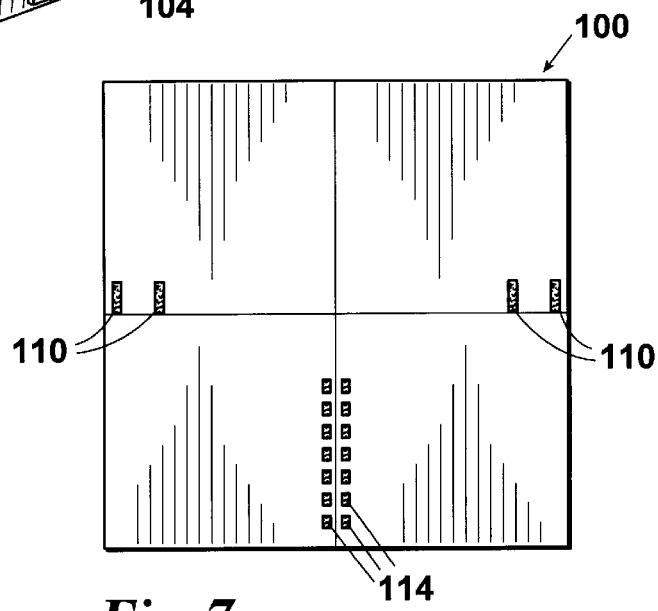
*Fig. 7*

FOLDABLE DISPLAY PANEL

BACKGROUND OF THE INVENTION

1. Field of the Invention

This invention relates generally to a foldable display panel. More particularly, but not by way of limitation, the present invention relates to a device used for entertainment purposes which comprises a panel upon which is provided a scene and which optionally includes thereon the image of a character or images of characters. When a person places his or her face in a cutout provided therein, an impression is created that the person so doing is part of the scene or a character depicted therein. This impression is noticeably enhanced in a picture taken of the panel with a subject. In operation, the panel has a height and width much greater than its thickness. When not in use, the panel folds into a package of substantially reduced surface area, improving transportability and simplifying handling and storage.

2. Background

Rigid, non-foldable panels have long been in use for the purpose stated above, namely as a prop for photography. Found primarily at attractions, theme parks, and the like, these devices usually portray a scene and characters relevant to a particular setting. Hence, these panels have typically been manufactured one-at-a-time for a specific location and are neither inexpensive or transportable.

Generally, these panels are furnished by the operator of an attraction to provide an opportunity for visitors to photograph loved ones or friends, for visitors to be entertained, and to allow visitors to create a memorable souvenir.

While such panels have found wide use in permanent settings, there exists a need for similar devices at one-time events such as birthday parties, school carnivals and festivals, and the like. Unfortunately, the physical size of these panels makes them difficult to transport and difficult to store. In addition, the cost of manufacturing such devices one-at-a-time, for one-time use, is prohibitive. For these reasons, such panels have not enjoyed widespread use outside of a permanent installation.

It is thus an object of the present invention to provide a foldable display panel to facilitate transportation and storage of the inventive device.

It is a further object of the present invention to provide a foldable display panel which may be easily mass produced with well-known and established manufacturing techniques.

SUMMARY OF THE INVENTION

These and other objects and advantages are achieved in a foldable display panel wherein a plurality of individual panels, each panel being small enough to be easily transportable and storable, are hingably connected in such a manner that, in a folded state, the individual panels will fold into a single stack wherein the frontal surface area will be that of an individual panel and, in an unfolded state, the individual panels will unfold into a large flat panel wherein the frontal surface area will be substantially equal to the sum of the frontal surface areas of the individual panels. In the unfolded state, binders temporarily join the individual panels into a single, rigid panel.

In one embodiment of the inventive device, a stand is provided so that, when the panel is in its operational position, it will be self-supporting.

A scene displayed on the front side of the unfolded panel optionally includes one or more characters. Apertures may be provided as desired in which case a person may place his or her face in an aperture so as to incorporate that person's likeness into the scene or so that person becomes a character therein.

A better understanding of the present invention, its several aspects, and its objects and advantages will become apparent to those skilled in the art from the following detailed description, taken in conjunction with the attached drawings, wherein there is shown and described the preferred embodiment of the invention, simply by way of illustration of the best mode contemplated for carrying out the invention.

BRIEF DESCRIPTION OF THE DRAWINGS

FIG. 6 provides a rear perspective view of the foldable display panel with an optional stiffener and legs incorporated thereon.

FIG. 7 provides a rear elevational view of an embodiment of the foldable display panel.

DETAILED DESCRIPTION OF THE PREFERRED EMBODIMENT

Figure 1:
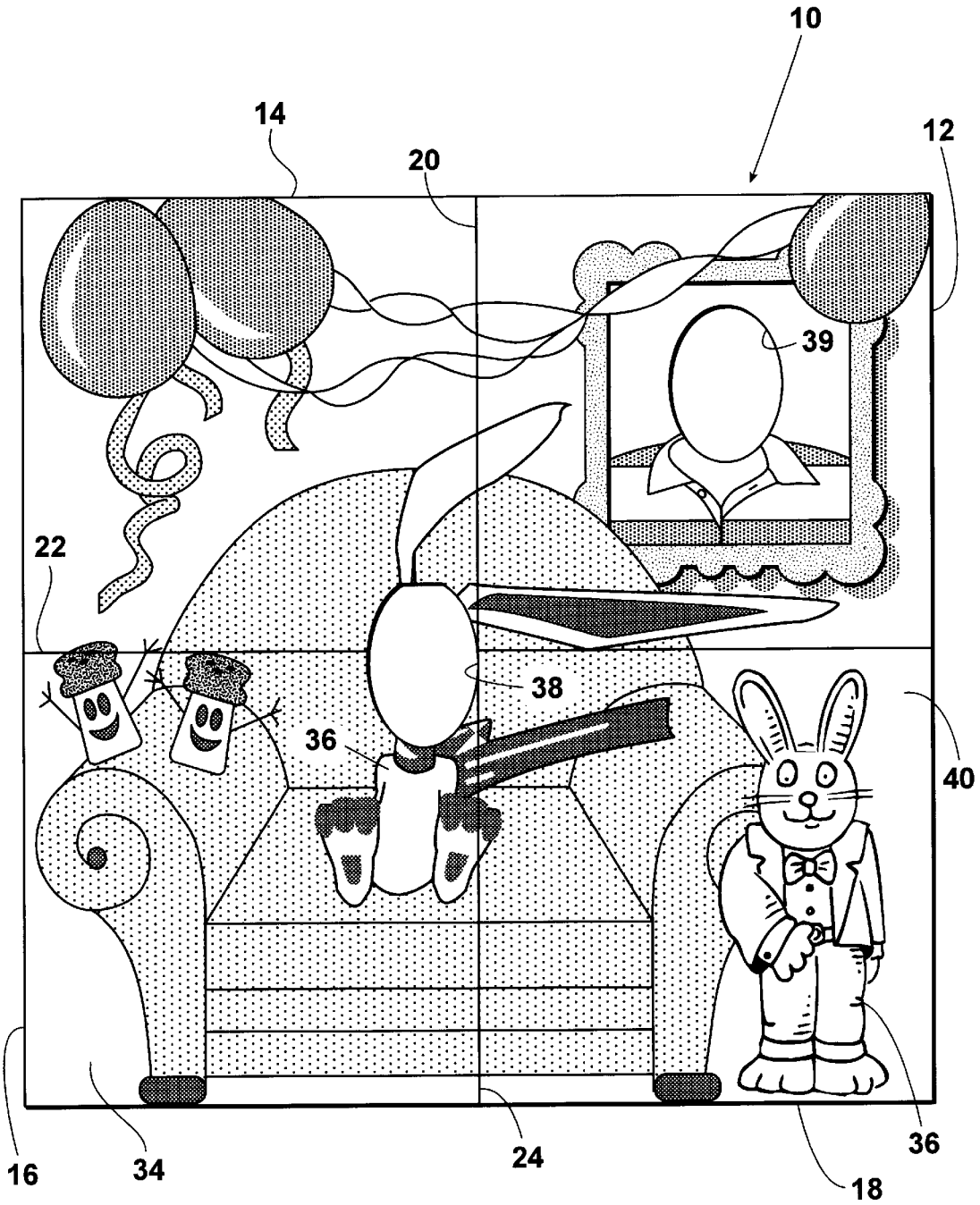
FIG. 1 shows an elevational front view of the inventive foldable display panel in the unfolded state.

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Referring now to the drawings, wherein like reference numerals indicate the same parts throughout the several views, a preferred embodiment of the inventive foldable display panel 10 is shown in its general environment. For use, the inventive device is outspread into an unfolded state to form a large flat panel. For transportation or storage, the inventive device collapses into a folded state to form a compact package.

Figure 2:
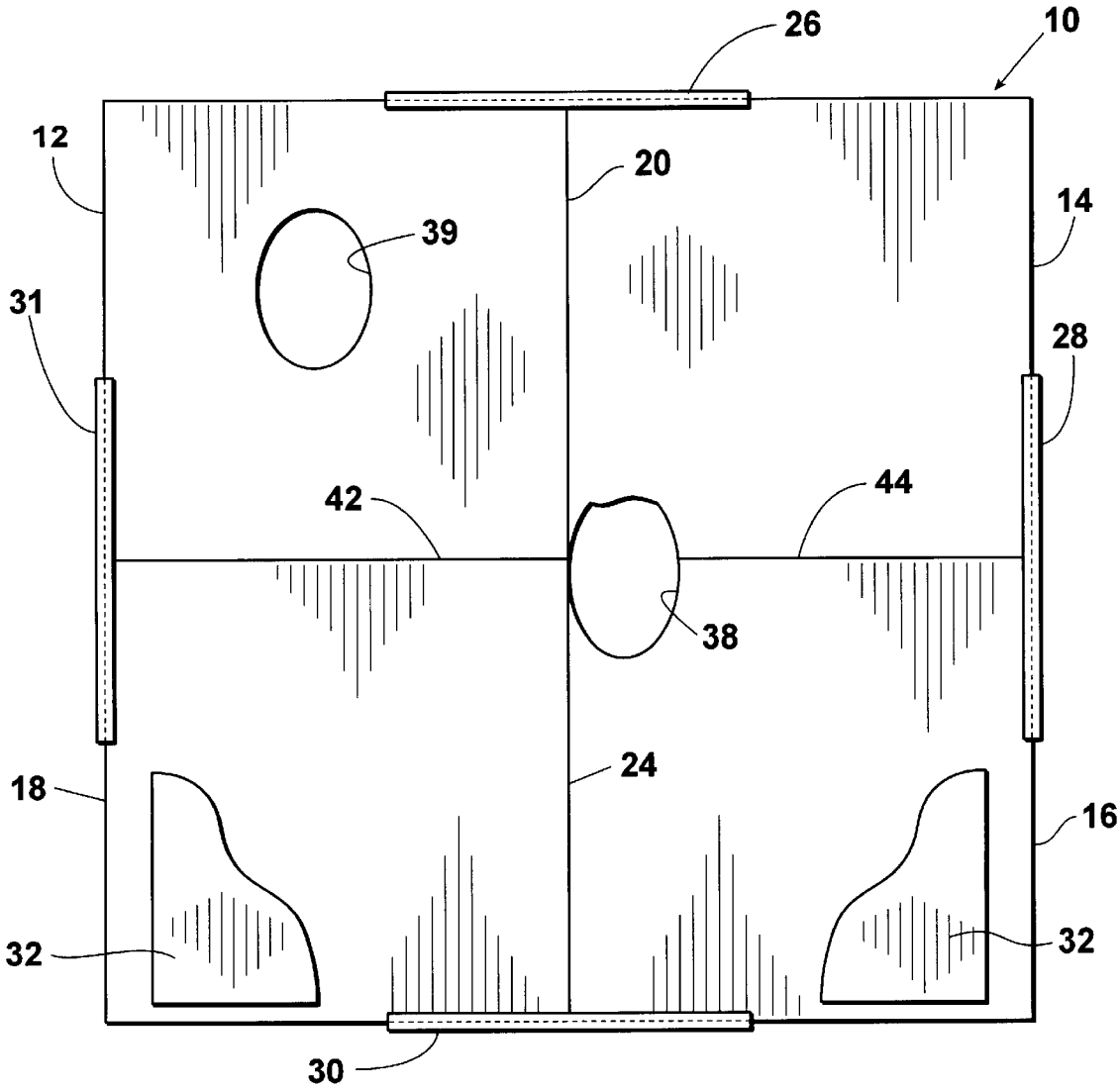
FIG. 2 shows an elevational rear view of the inventive foldable display panel and binders incorporated thereon.

Turning to FIGS. 1 and 2, foldable display panel 10 comprises a plurality of individual panels 12, 14, 16, and 18 connected at their juxtaposed edges with hinges 20, 22, and 24. The hinges allow for the display panel to be folded into a compact state in the manner described hereinbelow. When display panel 10 is in its unfolded state, binder 26 rigidly retains panel 12 to panel 14, binder 28 retains panel 14 to panel 16, binder 30 retains panel 16 to panel 18 and binder 31 retains panel 12 to panel 18. Once binders 26–31 have been properly placed along the edges of panel 10, the four individual panels 12–18 form one large display panel 10 whose frontal surface area is substantially the sum of the frontal surface areas of the individual panels 12–18. Preferably, binders 26-31 are formed of a substantially transparent material.

Figure 4:
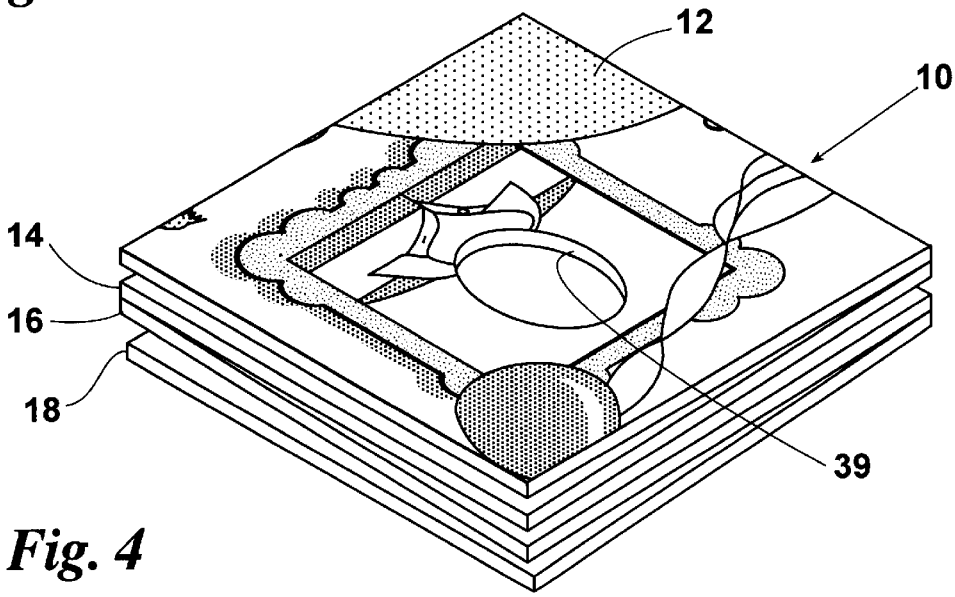
FIG. 4 shows a perspective view of the inventive foldable display panel in the folded state.
Figure 3:
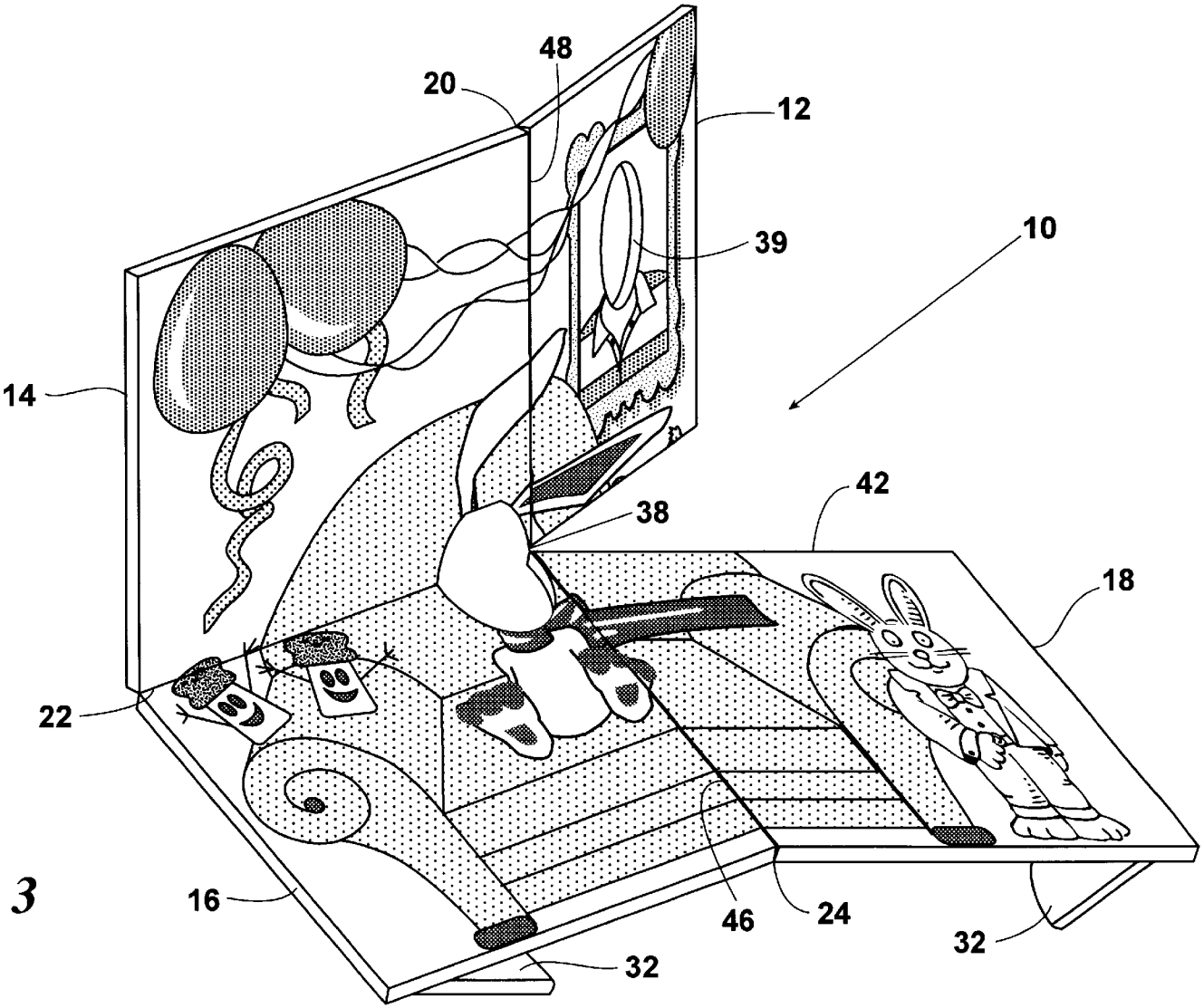
FIG. 3 shows a perspective front view of the inventive foldable display panel in a partially folded state.

The seam between the juxtaposed edges of panel 12 and panel 18 is not hinged. Consequently, to collapse display panel 10 into its folded state, as shown in FIGS. 3 and 4, panel 12 folds rearward so that panel 12 and panel 14 are back-to-back. Similarly, panel 18 folds rearward so that panel 18 and panel 16 are back-to-back. Finally, panel 14 folds forward so that panel 14 and panel 16 are face-to-face. The four panels 12–18 are thus placed in a single stack (FIG. 4) wherein the frontal surface area of the combination is the same as the frontal surface area of an individual panel 12, 14, 16, or 18.

In a preferred embodiment of the inventive foldable display panel, easel stands 32 are provided on backside of panels 16 and 18 such that when stands 32 are extended, display panel 10 will support itself in a free-standing vertical position.

Referring again to FIG. 1, foldable display panel 10 includes a display 40 on its front surface 34 preferably incorporating background scenery and one or more characters 36. As appropriate to the scenery and characters 36, one or more apertures 38 and 39 (two shown) are provided through display panel 10 wherein a person may place his or her face to incorporate that person's likeness into the picture.

To produce foldable display panel 10, individual panels 12, 14, 16, and 18 are formed from a thin rigid material such as wood, foam core, plastic, sheet metal, or the like. Hinges 20, 22, and 24 may comprise any type of hinge mechanism, but are preferably made from a thin flexible material adhesively attached to individual panels 12–18.

Apertures 38 and 39 may be formed in individual panels 12–18 in a variety of ways. Typically, if individual panels 12–18 are made in a casting or molding process, apertures 38 would be formed as a part of the casting or molding process. If, on the other hand, individual panels 12–18 are cut from a larger sheet of material, apertures 38 would typically either be formed in the panel cutting operation or in a secondary cutting operation.

Display 40 may be applied by directly printing or painting on individual panels 12–18 or, alternatively, display 40 may be printed on a separate media and adhesively attached to the foldable display panel 10.

In a particular embodiment, individual panels 12–18 are made from a single, large sheet of foam core material. Hinges 20–24 are made, capitalizing on an inherent characteristic of foam core, by leaving the outside cover intact on the hinge side of the foam core and cutting through the outside cover on the opposite side and the inner foam material. Referring to FIG. 2, the back cover of the foam core is cut along lines 42 and 44. The front cover of the foam core (see FIG. 3) is cut along lines 42,46, and 48. The. inner foam material is cut along all four lines 42–48. There is thus obtained a hinge 20–24 between the adjacent edges of the individual panels which allows for the aforedescribed folding pattern. Preferably, adhesive tape is applied along hinges 20–24 while the panel is in its folded state, bridging the inner foam of adjacent panels to reinforce hinges 20–24. Binders 26–31 are separate pieces, attached at the time of unfolding.

Display 40 is printed onto paper, vinyl, or other thin flexible material and adhesively attached to display board 10. The display 40 is then cut along lines 42, 46, and 48 where the front outside cover of the foam core material had previously been cut. Apertures 38 are then die cut, simultaneously, through the display 40 and individual panels 12–18 as required. Easel stands 32 are likewise made from foam core material and foldably attached to the backs of panel 16 and panel 18 with flexible adhesive tape.

In another preferred embodiment, the foldable display panel 10 is produced from a single sheet of cardboard or like material which can be folded along embossed or crimped lines. Display 40 is preferably printed directly on panel 10. In a single stamping operation, dies cut line 42, apertures 38 and 39, and emboss lines 44, 46 and 48 to facilitate folding the panel. Easel stands 32 may be adhesively attached after the stamping operation. Binders 26–31 attach as in the previous example.

It will be apparent to those skilled in the art that while the preferred embodiment of the inventive device has been described with reference to a foldable display panel comprised of four individual panels, any number of individual panels could be used, as long as the placement of individual hinges results in a structure wherein sequential folding of the individual panels occurs in an alternating fashion, front-to-front and back-to-back.

It will also be apparent to those skilled in the art that while the preferred embodiment of the inventive device has been described with reference to apertures through which a person's face is displayed, alternative methods for incorporating the person's likeness into the picture are possible and are encompassed within the spirit of the invention. For example, a display panel could be constructed such that a depicted character's body extends to the top edge of the board such that the neck and head of a person standing behind the board would be visible extending from the top edge of the panel above the character's body.

Figure 5:
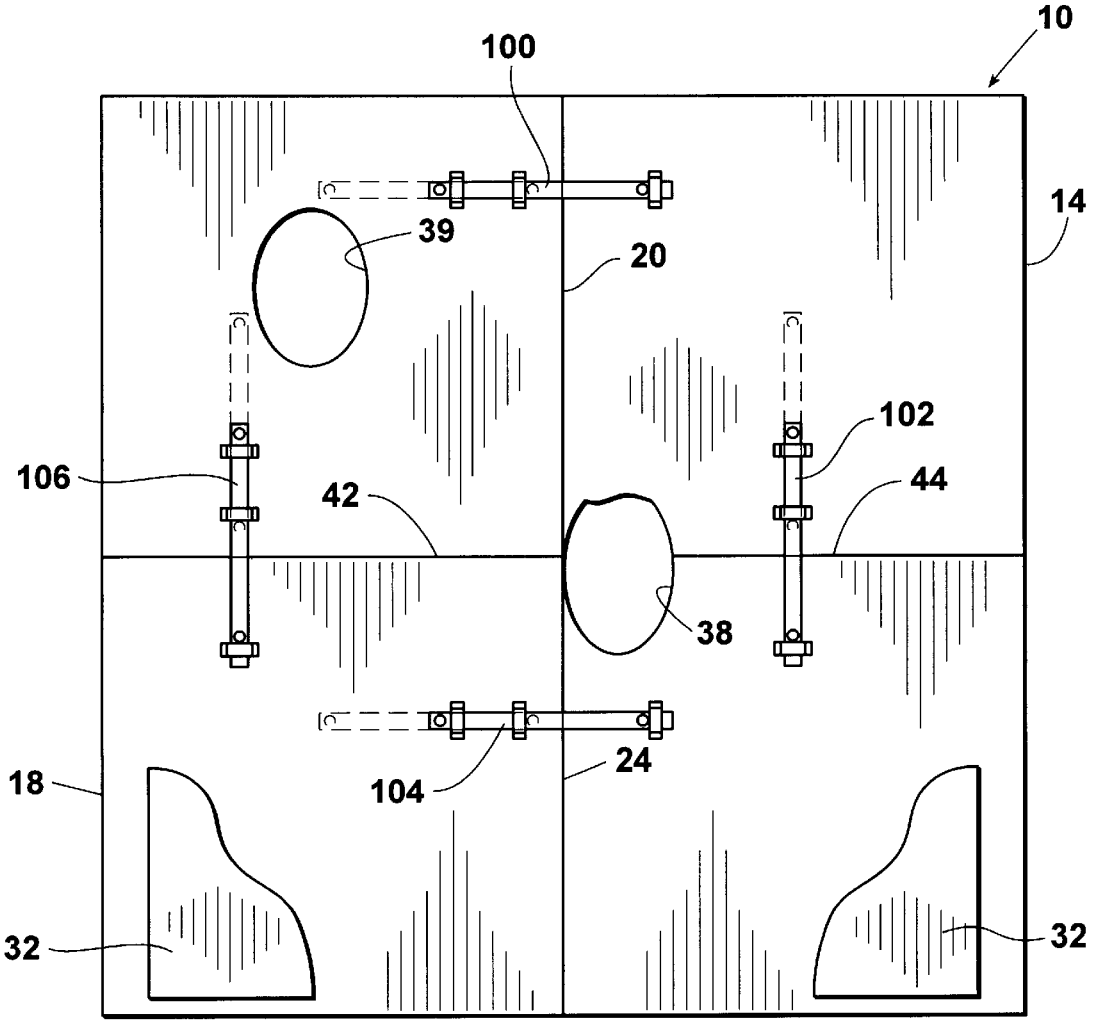
FIG. 5 shows an elevational rear view of the inventive foldable display panel with another embodiment of binders incorporated thereon.
Figure 8:
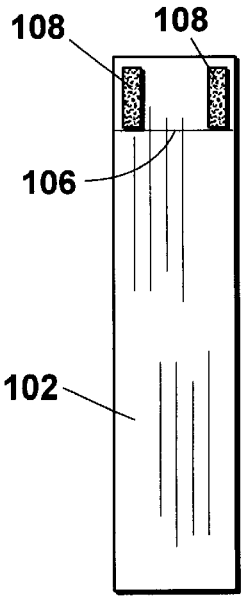
FIG. 8 shows a front view of a leg for attachment to a foldable display panel.
Figure 9:
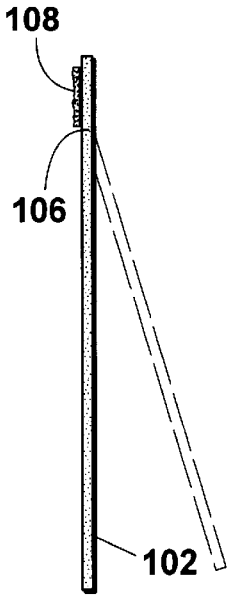
FIG. 9 shows a side view of a leg for attachment to a foldable display panel.
Figure 10:
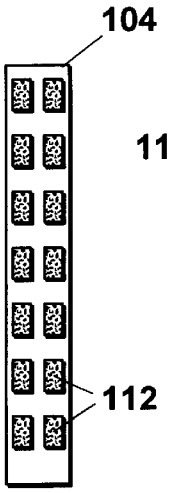
FIG. 10 shows a front view of a stiffener for attachment to a foldable display panel.
Figure 11:
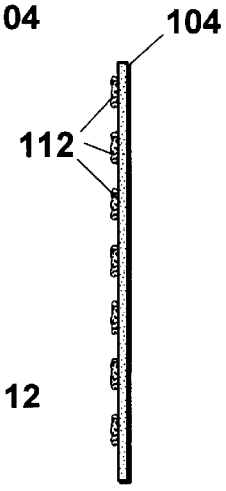
FIG. 11 shows a side view of a stiffener for attachment to a foldable display panel.

Binders 26–31 are preferably somewhat rigid plastic channels which slide tightly over the edges of unfolded panel 10. However, it will be apparent to those skilled in the art that numerous devices are known for temporarily joining the individual panels into a single, substantially rigid panel and the term "binder",is intended to include such devices. An example of one such alternative binder useful when a heavier panel material is utilized is shown in FIG. 5, wherein latches are adhesively attached to the back of panel 10 to serve as binders such that when engaged, the individual panels are joined across edges 20, 24, 42, and 44.

In another preferred embodiment, as shown in FIGS. 6–11, foldable display panel 100 includes legs 102 and stiffener 104. Legs 102 and stiffener 104 are preferably made from the same material as panel 100. Leg 102 includes hinge 106 (FIGS. 8 and 9) and hook-and-loop fastener strips 108. Hook and loop fastener strips. 108 mate with opposing hook-and-loop fastener strips 110 attached to panel 100. Likewise, stiffener 104 includes a plurality of hook-and-loop fastener strips 112 for mating with opposing hook-and-loop fastener strips 114 attached to panel 100. It should be noted that while stiffener 104 is not necessary to the operation of panel 100, the inclusion of stiffener 104 noticeably enhances the overall rigidity of panel 100 in its unfolded state.

A display panel constructed in accordance with the invention might also be usable as a stage prop or other display, for example, a point-of-sale display, without departing from the spirit and scope of the invention. As will be apparent to one skilled in the art, when used for such purpose, a display panel would not necessarily include apertures as depicted in FIGS. 6 and 7.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A foldable display panel comprising:

at least three individual panels, each of said panels having a front and a back and at least one edge juxtaposed to an edge of adjacent panel;

a plurality of hinges connecting less than all of said juxtaposed edge, wherein said individual panels are foldably attached, one-to-another, by one of said hinges such that as said individual panels are sequentially folded, said individual panels fold alternatingly, front-to-front and back-to-back and, when said panels are in an unfolded condition, said plurality of individual panels form a display panel having a frontal surface area substantially equal to the sum of the frontal surface areas of said individual panels;

a scene provided on the frontal surface of said display panel; and a plurality of apertures, each aperture of said plurality of apertures being of a size and shape to receive a person's face and each aperture of said plurality of apertures being positioned on said display panel such that, when a face is inserted in said each aperture, said face becomes a part of said scene.

2. The foldable display panel of claim 1 further comprising:

at least one easel stand, said easel stand foldably attached to said back of one of said individual panels.

3. The foldable display panel of claim 1 further comprising:

(c) a plurality of binders, said binders operational to temporarily connect at least two of said individual panels together to form a rigid structure.

4. The foldable display panel of claim 1 wherein said of individual panels are formed from a single sheet of a rigid material having a front flexible cover, a back flexible cover, and a core material.

5. The foldable display panel of claim 4 wherein each of said hinges comprises either said front flexible cover or said back flexible cover.

6. The foldable display panel of claim 1 wherein said individual panels and said hinges are formed from a single sheet of cardboard.

* * * * *